United States Patent [19]

Sudmanns

[11] Patent Number: 5,022,227

[45] Date of Patent: Jun. 11, 1991

[54] PIPE CARRYING HOT GASES FOR AN INTERNAL-COMBUSTION ENGINE

[75] Inventor: Hans Sudmanns, Friedrichshafen, Fed. Rep. of Germany

[73] Assignee: Mtu Motoren-und Turbinen-Union Friedrichshafen GmbH, Friedrichshafen, Fed. Rep. of Germany

[21] Appl. No.: 423,409

[22] PCT Filed: Nov. 9, 1988

[86] PCT No.: PCT/DE88/00697

§ 371 Date: Aug. 22, 1989

§ 102(e) Date: Aug. 22, 1989

[87] PCT Pub. No.: WO89/05911

PCT Pub. Date: Jun. 29, 1989

[30] Foreign Application Priority Data

Dec. 23, 1987 [DE] Fed. Rep. of Germany ..... 3743851

[51] Int. Cl.[5] ..... F01N 7/00

[52] U.S. Cl. ..... 60/320; 60/321; 60/322; 60/323

[58] Field of Search ..... 60/321, 322, 323, 320

[56] References Cited

U.S. PATENT DOCUMENTS

| | | | |
|---|---|---|---|
| 3,908,369 | 9/1974 | McAdams | 60/322 |
| 4,086,763 | 5/1978 | Matsushita et al. . | |
| 4,197,704 | 4/1980 | Date | 60/322 |
| 4,463,709 | 8/1984 | Pluequet | 60/321 |
| 4,869,064 | 9/1989 | Deutschmann | 60/322 |

FOREIGN PATENT DOCUMENTS

| | | |
|---|---|---|
| 0079511 | 10/1982 | European Pat. Off. . |
| 926578 | 4/1955 | Fed. Rep. of Germany . |
| 2602434 | 7/1977 | Fed. Rep. of Germany . |
| 8013256 | 10/1986 | Fed. Rep. of Germany . |

*Primary Examiner*—Douglas Hart

*Attorney, Agent, or Firm*—Barnes & Thornburg

[57] ABSTRACT

The fastening of the thin-walled exhaust pipe inside the liquid-cooled covering takes place by means of screws which are distributed in a cross-sectional plane of the exhaust pipe at the circumference. For receiving the screws, brackets are arranged in the wall of the exhaust pipe which have an internal thread corresponding to the screws. In the mounted state, in the area of each bracket, a radially smaller dimensioned space exists between the exhaust pipe and the covering, which smaller space is eliminated after the tightening of the screws. Instead, the pipe is deformed in the cross-sectional plane of the screws in the sections between the brackets. The extent of the deformation depends on the magnitude of the thermal expansion of the pipe to be expected at the operating state, no constraining forces therefore occur at the pipe which endanger the operation and which result from an obstructed thermal expansion.

6 Claims, 3 Drawing Sheets

PIPE CARRYING HOT GASES FOR AN INTERNAL-COMBUSTION ENGINE

BACKGROUND AND SUMMARY OF THE INVENTION

The invention relates to a pipe carrying hot gases for an internal-combustion engine which is surrounded with a spacing by a liquid cooled covering and with several brackets arranged at the thin walled pipe and fastening means interacting with the brackets to fix the pipe at the covering. By means of this type of an arrangement, it is prevented that the hot gas comes in direct contact with the liquid-cooled covering, whereby the influx of heat into the coolant is kept low.

An arrangement of this type of a pipe carrying hot gases is known from German Utility Model (DE-GM) 80 13 256. Several flange-type brackets are distributed over the length at each longitudinal side of the thin-walled pipe and rest against a corresponding flange surface of the liquid-cooled covering. The fastening of the pipe takes place by means of screws inserted vertically with respect to the flange face. The high temperatures of the hot gases, which occur during the operation, result in considerable thermal expansion differences between the pipe and the covering, which are compensated only partly by the fastening. Thermal expansions which cannot be compensated result in constraining forces of expansion which result in a stress to the material which cannot be calculated. The effects of the constraining forces of expansion, when added to the stress to the internal-combustion engine caused by the operation, such as vibration and gas pulsation, result in a stressing of the pipe which endangers the operation.

It is therefore the object of the invention to provide a pipe for carrying hot gases for an internal-combustion engine which results in an operationally safe connection between the pipe and the liquid-cooled covering.

According to the invention, this object is achieved by providing an arrangement characterized in that the connection of the pipe and the covering takes place in only one cross-sectional plane, in that at least two brackets are distributed in the cross-sectional plane at the circumference of the pipe, in that each bracket has a fastening arrangement radially interacting with a fastening device, and in that the pipe, in the mounted state, in the area of each bracket, has a radially smaller dimensioning with respect to the covering, which is eliminated after the effect of the fastening devices. After the installation of the pipe into the covering, the wall sections between the brackets are deformed by tensile stress at least in areas on both sides of the cross-sectional plane of the screws. The deformation is in the magnitude of the thermal expansion to be expected at the operating temperature. The deformation of the pipe generated in the cold state, will decline during the heating, in which case the tensile stress is reduced. In the case of this, as it were, programmed thermal expansion of the pipe, a stressing of the material, that cannot be calculated, by means of constraining forces, is avoided. Other developments of the invention are found in the various claims.

The advantages achieved by means of the invention are mainly that the generating of the pipe deformation takes place necessarily with the mounting of the fastening devices, that the fastening devices can be controlled from the outside, that the smaller dimensioning, which results in the deformation of the pipe, can be measured clearly during the mounting and that a low-cost production of the pipe fastening is obtained.

Other objects, advantages and novel features of the present invention will become apparent from the following detailed description of the invention when considered in conjunction with the accompanying drawings.

DETAILED DESCRIPTION OF THE DRAWINGS

Figure 1:
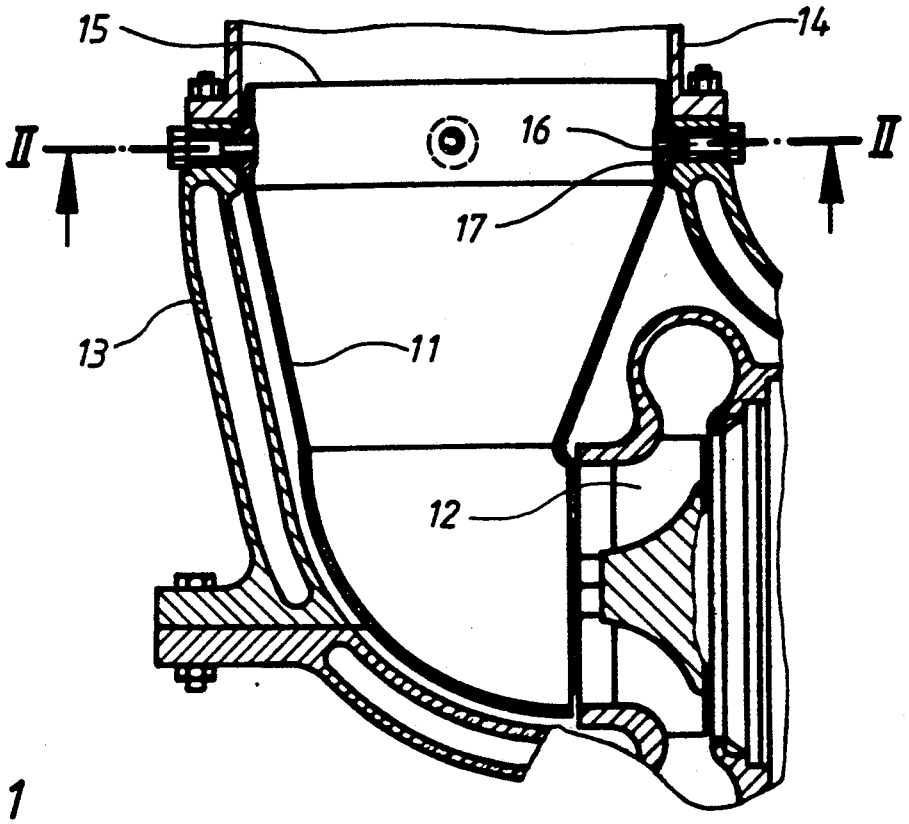
FIG. 1 is a partial cross-sectional view of an exhaust gas turbine having a pipe carrying hot gases, in the exhaust gas outlet according to Line I—I in FIG. 2.
Figure 2:
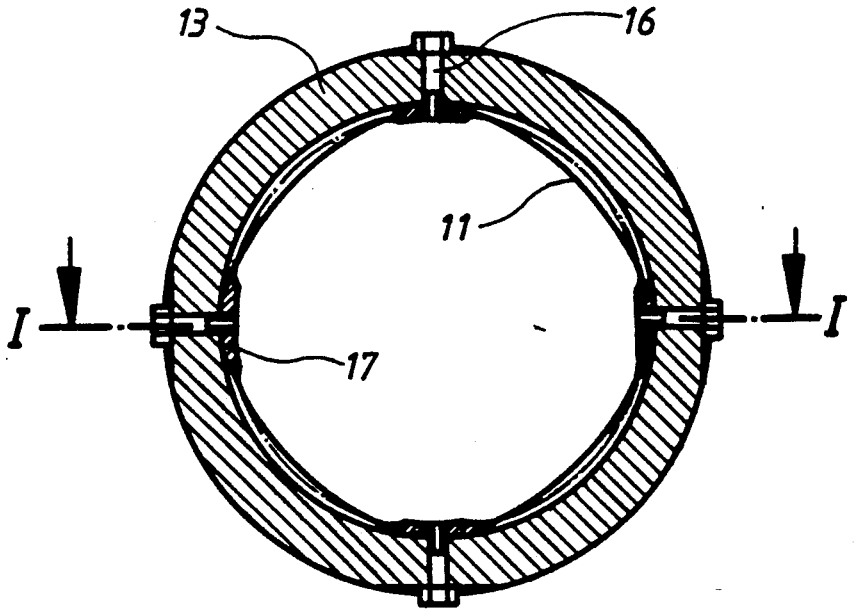
FIG. 2 is a sectional view of the fastening plane of the pipe according to Line II—II in FIG. 1.

Between an exhaust gas turbine 12 and an exhaust pipe 14, a pipe 11 is arranged which receives the hot exhaust gases of the exhaust gas turbine 12 (FIG. 1 and FIG. 2). The thin-walled pipe 11 is surrounded by a liquid-cooled covering 13, to which the pipe 11 and the exhaust pipe 14 are fastened. The connection between the pipe 11 and the covering 13 takes place at the outlet end 15 of the pipe 11 by means of four screws 16, which are arranged radially and in a cross-sectional plane. The wall of the pipe 11, in the cross-sectional plane, corresponding to the circumferential distribution of the screws 16, is equipped with lentiform brackets 17 which each have a nut thread corresponding to the screws 16.

In the initial phase of the mounting, when the pipe 11 is pushed into the covering 13, the pipe 11, in the area of each bracket 17, has a radially smaller dimension. By means of the screws which engage in the nut threads of the brackets 17 and are tightened, the pipe, while its cross-sectional contour is deformed, in the area of each bracket 17, is pulled against the covering. The originally present radially smaller dimensioning will then no longer exist. Instead, the pipe 11, in the cross-sectional plane of the screws 16 in the wall sections between the brackets 17, is deformed in comparison to the contour shown in FIG. 2 by drawn-out lines. The radially smaller dimensioning between the brackets 17 at the pipe 11 and the covering 13, which causes the deformation is selected such that a deformation occurs which is in the magnitude of the thermal expansion to be expected at the operating temperature of line 11. As a result, in the case of the operating temperature of the pipe 11 caused by the thermal expansion, a decline takes place of the deformation generated in the cold state. In the wall sections between the brackets 17, the pipe 11 will then assume the contour shown by a dash-dotted line in FIG. 2. An obstruction of the thermal expansion cannot occur. In the warm operating state, the pipe is therefore relieved from constraining forces which endanger the operation and result from the obstructed thermal expansion.

Figure 6:
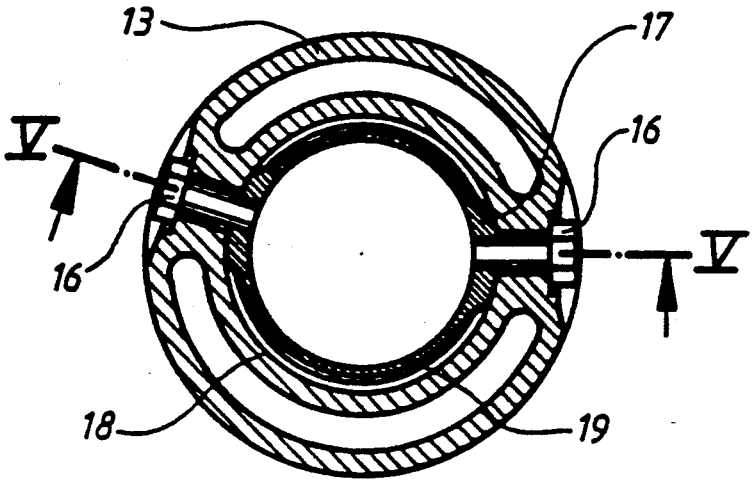
FIG. 6 is a sectional view of the fastening plane of the pipe according to Line VI—VI in FIG. 5.

An arrangement of the brackets 17, which is irregular in circumferential direction, as shown in the embodiment of FIG. 6, improves the vibrating behavior of the pipe 11. Wall sections of different lengths between the brackets 17 have different characteristic frequencies so that the vibrations of the pipe which are incited by the pulsating exhaust gas flow, in this manner, cannot build up to a resonant vibration which endangers the operation.

Figure 3:
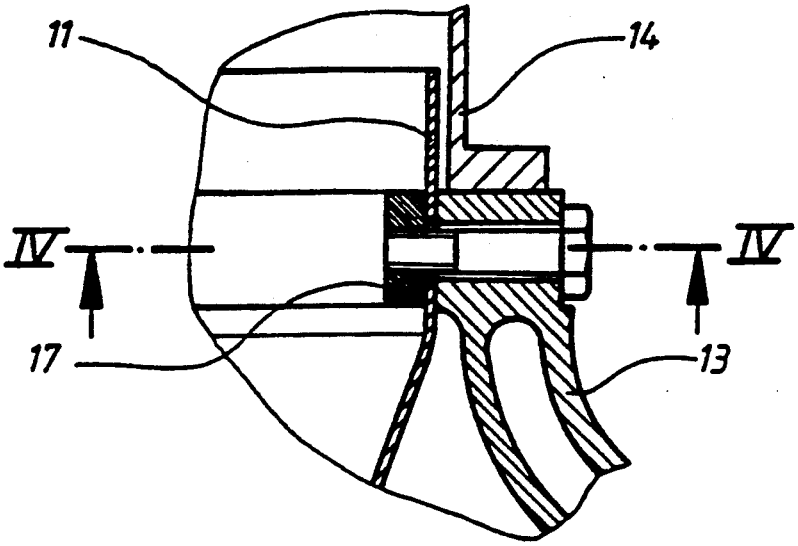
FIG. 3 is a cutout of a pipe carrying hot gases with an inserted clamping ring according to Line III—III in FIG. 4.
Figure 4:
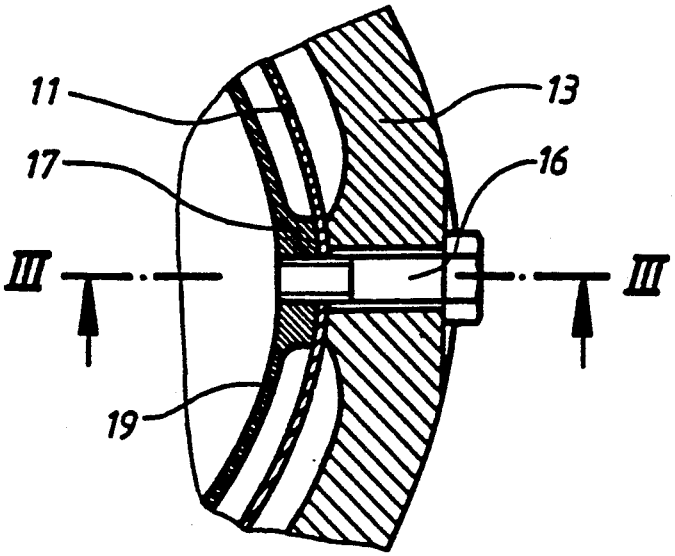
FIG. 4 is a sectional view of the fastening plane of the pipe according to Line IV—IV in FIG. 3.

In FIGS. 3 and 4, a second embodiment is shown of a pipe 11 carrying hot exhaust gases, which refers to the situation shown in FIG. 1 and 2. However, the pipe 11 is constructed to have a smooth wall in the fastening plane and, with respect to the covering 13, in the mounted condition, has the smaller dimension required for the deformation. A clamping ring 19 is loosely inserted into the interior of the pipe 11, this clamping ring 19, by means of its radially projecting bracket 17, resting against the interior side of the pipe 11. The fastening of the pipe 11 and the clamping 19 to the covering 13 again takes place by means of screws 16, which penetrate the pipe 11 at through-holes and are screwed into the brackets 17. The pipe 11 and the clamping ring 19, as described above, are deformed after the tightening of the screws 16. The advantage of this construction is that the pipe 11 can be constructed without any weld seam or with less weld seams. In addition, different materials may be selected for the pipe 11 and the clamping ring 19.

Figure 5:
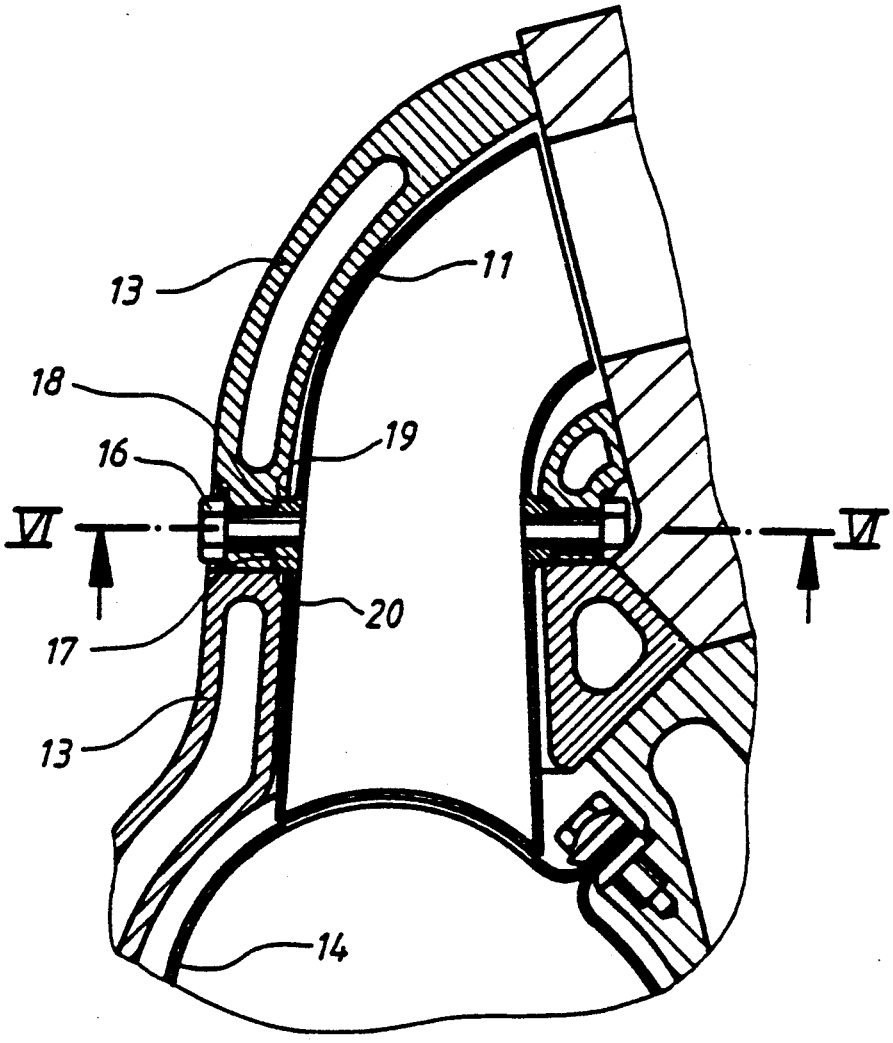
FIG. 5 is a partial sectional view of an internal-combustion engine with a pipe carrying hot gases in the exhaust gas outlet of a cylinder according to Line V—V in FIG. 6.

A third embodiment is shown in FIGS. 5 and 6 which shows a pipe 11 carrying hot exhaust gases inside a liquid-cooled covering 13 at the exhaust gas outlet of a cylinder of an internal-combustion engine. The fastening between the pipe 11 and the covering 13 takes place by means of two screws 16 arranged radially in a cross-sectional plane. The cross-sectional plane with the screws 16 is arranged approximately in the center of the longitudinal course of the pipe 11. For receiving the screws 16, the wall of the pipe 11 is equipped with brackets 17. As described with respect to the embodiment in FIG. 1 and 2, also in the case of the second embodiment, in the cold state, a radially smaller dimensioning exists between the pipe 11 in the area of each bracket 17 and the covering 13. By means of the tightening of the screws 16, the pipe 11 in the wall sections between the brackets 17 is deformed by means of tensile stress. The resulting cross-sectional contour of the pipe 11 between the brackets 17 in the fastening plane of the screws 16 corresponds to the representation in FIG. 2 for the cold state and for the warm operating state.

The brackets 17 are formed by two shoulders 19, 20 which project radially beyond the outer circumference of the pipe 11 and interact with corresponding recesses 18 in the covering 13, by means of which the pipe 11 is fixed in axial direction.

I claim:

1. An exhaust pipe for an internal combustion engine, the exhaust pipe having a thin-walled construction, a normal cross-sectional area in a cold condition and being gas-tightly surrounded by a liquid-cooled covering which is spaced by a distance from the exhaust pipe; fastening means for elongating the normal cross-sectional area of the exhaust pipe and for attaching the exhaust pipe only to the covering in only one cross-sectional plane; the fastening means being attached to the exhaust pipe in its cold condition at said cross-sectional plane and being operated to pull out the exhaust pipe at that plane to elongate the cross-sectional area while maintaining the attachment to the covering.

2. An exhaust pipe according to claim 1, wherein the fastening means includes fastening point projections attached to the exhaust pipe that extend outwardly therefrom and toward the covering.

3. An exhaust pipe according to claim 2, wherein the projections are constructed as a fixed component of the pipe.

4. An exhaust pipe according to claim 2, wherein the projections are constructed as a component of a clamping ring which can be inserted into the pipe.

5. An exhaust pipe according to claim 4, wherein the fastening means are constructed as screws which engage in a nut thread in the projections.

6. An exhaust pipe according to claim 1, wherein the exhaust pipe is arranged at an exhaust gas outlet of a gas turbine.

* * * * *